US009616288B2

(12) United States Patent
Greenberg et al.

(10) Patent No.: US 9,616,288 B2
(45) Date of Patent: Apr. 11, 2017

(54) VIRTUAL EXERCISER DEVICE

(75) Inventors: Nelson Greenberg, Dollard-des-Ormeaux (CA); Neil Trevick, Montreal (CA)

(73) Assignee: NEWHULA.COM, Saint-Laurent (CA)

( * ) Notice: Subject to any disclaimer, the term of this patent is extended or adjusted under 35 U.S.C. 154(b) by 651 days.

(21) Appl. No.: 13/261,465

(22) PCT Filed: Apr. 5, 2011

(86) PCT No.: PCT/CA2011/000355
§ 371 (c)(1),
(2), (4) Date: Oct. 4, 2012

(87) PCT Pub. No.: WO2011/123932
PCT Pub. Date: Oct. 13, 2011

(65) Prior Publication Data

US 2013/0123955 A1 May 16, 2013

Related U.S. Application Data

(60) Provisional application No. 61/321,181, filed on Apr. 6, 2010.

(51) Int. Cl.
*A61B 5/0205* (2006.01)
*A63B 24/00* (2006.01)
(Continued)

(52) U.S. Cl.
CPC ..... *A63B 24/0006* (2013.01); *A63B 19/00* (2013.01); *A63B 2071/0625* (2013.01); *A63B 2220/80* (2013.01); *A63B 2220/833* (2013.01)

(58) Field of Classification Search
CPC .... A63B 2071/0625; A63B 2024/0071; A63B 2024/0096; A63B 2220/40; A63B 2220/803; A63B 2220/836; A63B 24/0059; A63B 24/0062; A63B 19/00; A63B 2220/80; A63B 2220/833; A63B 24/0006;
(Continued)

(56) References Cited

U.S. PATENT DOCUMENTS 8,342,901 B1 * 1/2013 Deluz ..... 446/175
2007/0112286 A1 * 5/2007 Prichard ..... 600/595
(Continued)

FOREIGN PATENT DOCUMENTS

GB 2 432 282 5/2007
WO PCT/US2010/021633 8/2010

*Primary Examiner* — Justin Myhr
(74) *Attorney, Agent, or Firm* — Philip Swain; IPSIS, Inc.

(57) ABSTRACT

Disclosed herein is a device which detects repetitive movement of a user's body part. The device has a sensor which detects G forces along at least two axes when the user repeatedly moves the body part; a memory, which stores reference data corresponding to ideal reference data; a processor/computing unit, which communicates with the sensor and the memory, and receives data associated with the G forces. The processing/computing unit compares the ideal reference data with the data associated with the detected G forces. A feedback component is connected to the processor/computing unit to provide the user with a signal when a target has been achieved. Also disclosed is a method of computing data received by the device and an exerciser device that simulates the movement of a hula hoop.

23 Claims, 6 Drawing Sheets

(51) Int. Cl.
*A63B 19/00* (2006.01)
*A63B 71/06* (2006.01)

(58) Field of Classification Search
CPC ..... A63F 2300/1006; A63F 2300/1043; A63F 2300/105
See application file for complete search history.

(56) References Cited

U.S. PATENT DOCUMENTS

2008/0090703 A1* 4/2008 Rosenberg ..... 482/8
2008/0300914 A1* 12/2008 Karkanias ..... A63B 24/0084 705/2

* cited by examiner

VIRTUAL EXERCISER DEVICE

RELATED APPLICATION(S)

This application is a continuation of International Application No. PCT/CA2011/000355, which designated the United States and was filed on Apr. 5, 2011, published in English, which claims the benefit of U.S. Provisional Application No. 61/321,181, filed on Apr. 6, 2010. The entire teachings of the above application are incorporated herein by reference.

TECHNICAL FIELD

The present relates to exerciser devices, and more particularly to virtual exerciser devices.

BACKGROUND

A conventional hula-hoop is a popular apparatus that is used for amusement and exercise by people of all ages. In its conventional form, a fairly large hoop is used by a person to carry out a repetitive, sometimes boring, motion. Conventional hula hoops are a simple hoop made of plastic, rubber or some other material, which may include optional features such as lights, rotation counters and the like. The use of the hula hoop requires a large immediate area in which to move the hoop. Disadvantageously, when used as an exercise device the hula hoop does not provide data or feedback, such as the duration and effectiveness of the exercise, to the user. Moreover, there are no known hula-hoops that permit a user to record current and historical usage data such as time and intensity, as well as the ability to compare one user to other users regardless of location. Such data and feedback is critical to the success of an exercise regime and encourages further use. Additionally, the space required to effectively use the hula hoop is generally at least twice the diameter of the hoop in use. This significantly increases the chance of hitting nearby objects, walls or people, which might cause injury. The space needed for a group of people wishing to simultaneously use hula hoops, such as in exercise groups, competitions or stage shows, often restricts the locations to larger areas such as gymnasiums, the outdoors or various large rented spaces. The use of hula hoops in smaller or confined spaces, such as clubs or in classrooms, is impractical or, in some cases, impossible.

Hula hoops are now considered an important and practical form of exercise for children in the classroom. However, the space required for carrying and transport of hula hoops makes this inconvenient and impossible in some cases. The awkward size and dimensions of a hula hoop makes transportation difficult; this is most evident when transporting hula hoops of various sizes or different types for users who need to exercise at different intensities or for exhibitions and demonstrations. While hula hoops exist that may be folded in half, the problem of restricted space is not addressed.

Hula hoop users may often wish to use music to accompany its use during exercise or for entertainment. This would, however, require transporting and use of additional devices, which might increase the weight and balance of the hula hoop. Some hula hoops exist with built in music playing devices, but the variety of music and or sounds is limited. Music and other sounds can make the hula hoop device more exciting, fun and encouraging to use. For competitions, stage shows and the like, this would be of particular use, especially if the volume can be controlled.

Thus, there is a need for an exerciser device that can mimic the movement of a conventional hula-hoop and which addresses the shortcomings described above.

BRIEF SUMMARY

Accordingly, there is provided a device for detecting repetitive movement of a body part of a user, the device comprising:

a sensor for detecting G forces along at least two axes when the user repeatedly moves the body part;

a memory for storing reference data corresponding to ideal reference data;

a processor/computing unit, in communication with the sensor and the memory, for receiving data associated with the G forces detected along the at least two axes, the processing/computing unit comparing the ideal reference data with the data associated with the G forces detected along the at least two axes detected by the sensor; and at least one feedback component connected to the processor/computing unit for providing the user with a signal indicating that a target has been achieved.

In one example, the G forces are detected along x- and z-axes.

In another example, the G forces are detected along x-, y- and z-axes.

In another example, the G forces in the x-axis are calculated using $X=A\sin(Bt+C)+D$; With Period=2pi/B; Phase=C/B and the G forces in the z-axis are calculated using $Z=A\sin(Bt+C)+D$; With Period=2pi/B; Phase=C/B, wherein D represents the offset from the neutral axis for the curves representing particular users; A represents amplitude; B represents angular frequency; and C represents phase.

In one example, the sensor is an accelerometer.

In another example, the sensor is a gyroscope.

In another example, the sensor, the memory, the processor/computing unit, and the feedback components are provided as a unitary body.

In another example, the device is adapted to be worn on a user's belt or waist.

In one example, the at least one feedback component includes a speaker and an amplifier, LED lighting, an LCD screen, or a wireless transreceiver.

In one example, the device in which x- and z-values detected in the x- and z-axes are taken from a user who is rotating his hips as if moving a virtual hula hoop.

In another example, the device is a cell phone, a PDA, a smart phone or a music playback device.

According to another aspect, there is provided a method for detecting repetitive movement of a user's body part, the method comprising:

electronically sensing G forces along at least two axes when the user repeatedly moves the body part in real time;

comparing first data associated with the G forces detected along the at least two axes in real time with second ideal reference data, the second ideal reference data being G forces detected along the at least two axes stored in a memory, the second ideal reference data being taken independently from the first data; and providing feedback to the user in real time when the user achieves the second ideal reference data.

In one example, the at least two axes are x- and z-axes. Values associated with x-axis represent forward and backwards movement of the user's hips and the values associated with the z-axis represent lateral movement of the user's hips. The method includes: obtaining maximum and minimum x and y values and storing the values as individual sets equal to individual i values. The method includes: obtaining 3 sets of maximum and minimum values; and calculating the average of these values is calculated using the following equation:

$$(\text{Max_}Xi+\text{Min_}Xi)/2$$

The method includes: calculating an average of the averages to acquire DX and DZ using the following equation:

$$(\text{Average}X1+\text{Average}X2+\ldots+\text{Average}Xi)/i=DX)$$

The method includes: electronically sensing an additional set of set of G force data in the x- and z-axes and normalizing the additional set of data on both axes using DX and DZ. The method includes: determining the maximum and minimum values of the G forces in the x- and z-axes; determining the period between the maximum and minimum values is found in both the x- and z-axes; comparing the maximum/minimum data with common maximum/minimum data; and repeating for the period against common period values.

In another example, the method includes: providing audible or visual feedback to the user when the second ideal reference data is achieved. The user is moving his waist as if mimicking the movement of a hula hoop.

In another aspect, there is provided a virtual exerciser device, comprising the device, described above, for simulating hula hoop movements. The exerciser device is worn on the waist of a user.

BRIEF DESCRIPTION OF THE DRAWINGS

In order that the present may be readily understood, embodiments are illustrated by way of example in the accompanying drawings.

Further details and advantages will be apparent from the detailed description included below.

DETAILED DESCRIPTION

In the following description of the embodiments, references to the accompanying drawings are by way of illustration of an example by which the discovery may be practiced. It will be understood that other embodiments may be made without departing from the scope of the discovery disclosed.

I. The Virtual Exerciser Device

Figure 1:
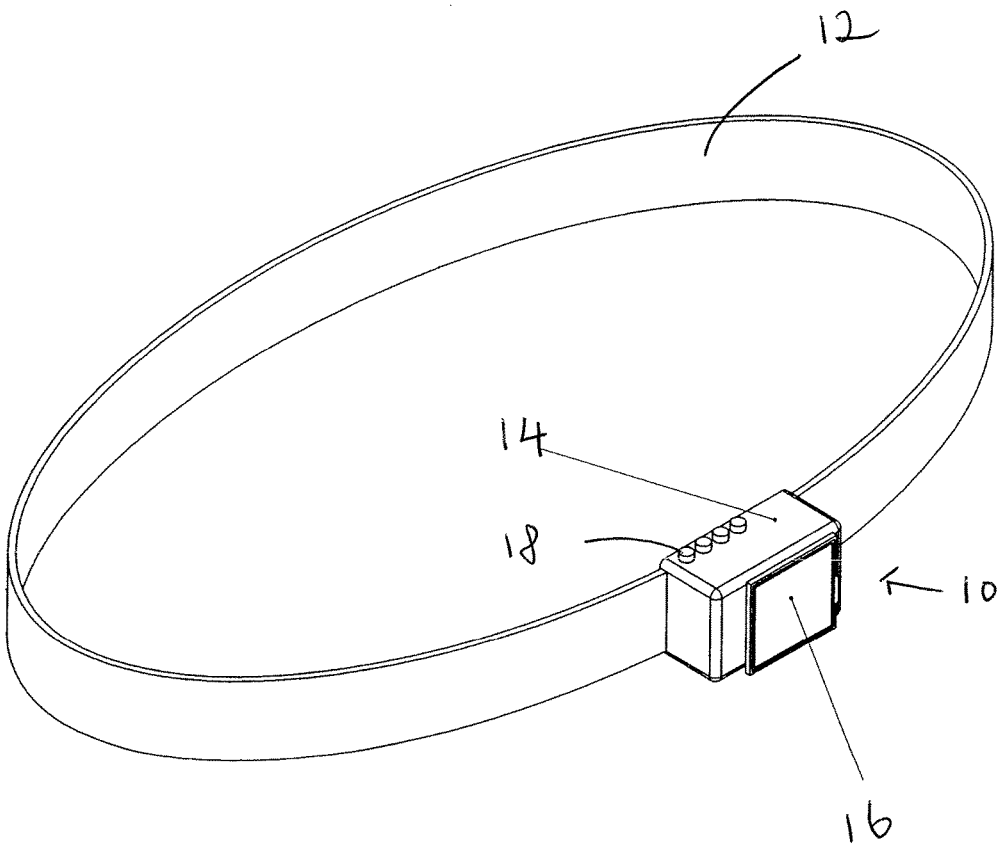
FIG. 1 illustrates a perspective view of a virtual exerciser device attached to a belt.

Referring now to FIG. 1, there is shown a device 10 useful for detecting movement of a body of a user. The device 10 may be a portable electronic device such as, for example, a cell phone, smart phone, PDA, or music play back device. The device 10 is typically connected to a belt or waist of the user and is used to detect the movement of the user's hips as they rotate to simulate the rotation of a hula hoop. In the example illustrated, the device 10 is connected to a belt 12. The device 10 can be placed securely on the user's body in any known manner using, for example, a hook and loop fastener, spring clip, tape, Velcro or adhesive. The device 10 includes an outer shell 14, an LCD screen 16 (for output visual data) and a plurality of switches/buttons 18 located for easy access by the user.

The device 10, when used on the waist is a unitary body that is very space efficient and is approximately the same size as a conventional smart phone. It is worn on a flexible belt about the body. It is light in weight and therefore easy to transport. Various hula hoop exercise routines require the use of different diameter hoops and different hoop weights. Generally the smaller the hoop the more difficult it is to keep the hoop in continuous rotation. Weight has the inverse affect for a given hoop diameter. With our device, the manipulation of variables in the software component can represent any size or weight of hoop, all within one small easily transportable device. Advantageously, the electronic device used is worn close to the body which significantly reduces the amount of space required to perform the hula hoop motion, perform exercises, shows or competitions to approximately twice the diameter of the person's body as compared to twice the diameter of a conventional hoop (about 8 feet). The processing capabilities of the device 10 when used in combination with the software described below permits a plurality of important features not available with any known existing hula hoop or facsimile thereof. Furthermore, the device 10 has the ability to record, transmit and compare with other users all data related to the use of a hula hoop such as current time in continuous rotation, accumulated time, accuracy and intensity of the related movements, and all for various size and weights of hoops. Additionally, the device provides visual and auditory feedback and guidance at the level of the device itself, or through other larger and remote devices, computers and networks, when the different transceivers in the device are used. The device 10 can also provide a wide variety of music and sounds to enhance the entertainment value, joy of use and desire to use it.

Figure 2:
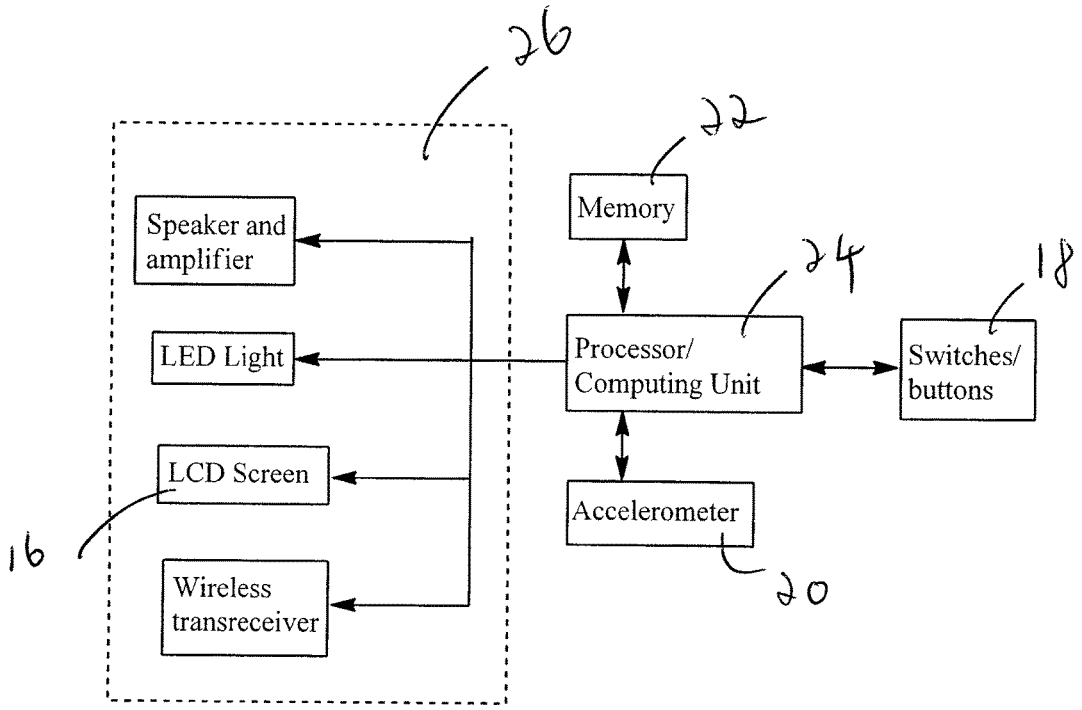
FIG. 2 is a block diagram showing components of the virtual exerciser device.

Referring now to FIG. 2, a schematic block diagram of the device 10 is illustrated showing its components. The device 10 comprises a sensor 20, a memory 22, a processor/computing unit 24 and a plurality of feedback components 26. The sensor 20, typically an accelerometer, detects the motion associated with G forces in at least two axes, for example, the x- and z-axes in a hula hoop example where the user rotates his hips, as if mimicking the rotation of the hula hoop. Also measurable using an accelerometer are G forces in the y-axis. Thus, the sensor 20 permits detection of motion associated with G forces in the x-, y- and z-axes. In the example hula hoop example illustrated below, data associated with the x- and z-axis motion is transmitted from the sensor 20 to the processor/computing unit 24, thereby permitting communication between the sensor 20 and the device 10. This is also achievable using data associated with the x-, y- and z-motions. The switches/buttons 18 are multi-positional and control operation of the device 10 by electrical communication therewith. In the example shown, the switch is a 3-position switch corresponding to START, PAUSE and STOP functions. The processor/computing unit 24 is connected to a plurality of feedback components 26 to provide the user with a signal that a target exercise level has been achieved. As illustrated, the feedback components 26 may include a speaker and an amplifier, which provides auditory feedback; LED lighting; the LCD screen 16; a wireless transreceiver such as Wifi/Bluetooth to communicate data with a personal computer. The Wifi and Bluetooth transrecievers operate in a standard range known to those skilled in the art. The LCD screen 16 provides the user with visual feedback through words and visualizable information. The processor/computing unit 24 is connected to and communicates with the sensor 20 and the memory 22; it controls all the features of the unit, its internal program and all output/input devices which are attached to the unit. The memory 22 is connected to the processor/computing unit 24 and electrically communicates therewith. The memory 24 stores data, such as an ideal range of data, collected from individuals known b be experts at the art of maintaining a conventional hula hoop in continuous rotation. An example of the memory 22 includes, but is not limited to, a Removable Media, SDcard. The processor/computing unit 24 compares the ideal range of data stored in the memory 22 with the data collected by the sensor 20 as the user rotates his hips as if mimicking the movement of a hula hoop. Once the ideal range of data is achieved, the processor/computing unit 24 communicates a signal to the feedback components 26, which are activated so as to provide the user with feedback, audible, visual or otherwise, that the ideal range of data has been achieved and that the user is deriving benefit from using the device 10. In another example, the sensor 20 might include a gyroscope such as that found in the iPhone 4 and other devices known to those skilled in the art. The gyroscope permits the measurement of changes in spatial position relative to a start point Thus, one could more accurately determine if the user is maintaining proper form during an exercise routine, or a sporting activity such as monitoring a golf or tennis swing.

Generally speaking, the device 10 compares a user's actual body motion with a target version of the body motion, and provides a audible or visual feedback to the user indicating correspondence between the actual user body motion and the target body motion. Two parameters of motion along x- and z-axes are detected and used to quantify the actual body motion. These parameters of motion represent the target body motion (against which the actual body motion is compared) correspond to the motion of, for example, using a hula hoop. The sensor 20 is generally constructed to locally measure a certain parameter of motion. Two typical parameters that are measured are G forces along the x- and z-axes. The sensor 20 includes a sensing mechanism and a microcontroller (not shown) constructed and arranged to convert a measurement signal from the sensing mechanism into an electronic form. Examples of sensors which may be used include, but are not limited to, commercially available accelerometers having the following specifications:

+/−8 g three axis accelerometer
2 mg resolution @ 60 Hz
Wide supply voltage range: 2.4V to 5.25V
Low power: 350 μA at VS=2.4 V
Good zero g bias stability
Good sensitivity accuracy
BW adjustment with a single capacitor
Single-supply operation
10,000 g shock survival
Compatible with Sn/Pb and Pb-free solder processes Examples of the processor/computing unit 24 include those with the following specifications:

ATMega328
AVR Core: 8-bit
Hardware Multiper
Flash: 32 kbytes
Included Boot Code
Operates on low voltage with low power consumption
USB-to-serial decoder Also included in the device 10 are multiple Digital and Analog Inputs/Output, such as a programmable EEPROM.

Depending on the sensing mechanism used (e.g., with respect to component quality or digital versus analog signal output), other electronic components including, for example, an analog/digital converter, a bandpass filter, and an amplifier, in a manner appropriate to particular operational requirements as is known in the art. The converted signal is then provided to processor/computing unit 24.

By comparing the measured parameter of the actual motion and the corresponding parameter of the target motion, the microcontroller determines a degree of correspondence between the actual body motion and the target body motion. In general, this degree of correspondence is considered over a continuous range, but, solely for the purpose of simplifying quantification, may be generally considered in terms of a large discrepancy between the actual body motion and the target body motion, a moderate discrepancy between the actual body motion and the target body motion, and substantially no discrepancy between the actual body motion and the target body motion.

The sensor 20, the memory 22, the processor/computing unit 24 and the feedback components 26 may be physically connected by wiring and the like or they may be provided with RF transceivers or receivers to send and receive information therebetween. In addition, the provision of separate elements 100, 102, and 103 is purely by way of example. It will be readily appreciated the constituent elements may be arranged or combined in a variety of combinations. For example, the memory 124 and microcontroller 126 of processing unit 102 may be incorporated into the feedback mechanism 103 (as embodied by a headset/earpiece as illustrated), so as to eliminate the need for a separate element 102.

II. The Software and Operation Thereof

Figure 3:
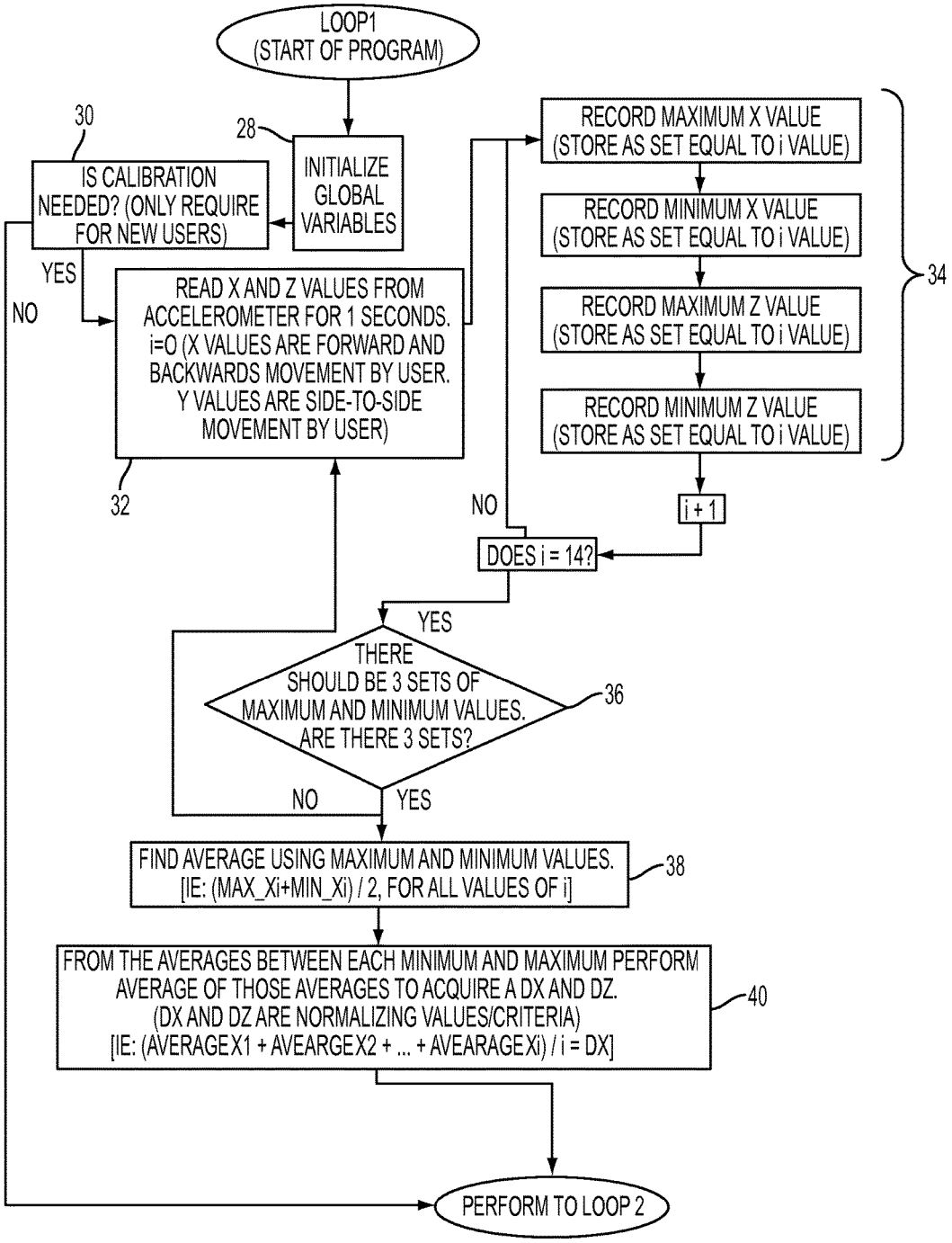
FIG. 3 is a flow diagram showing the Loop 1 method steps of the device program.
Figure 4:
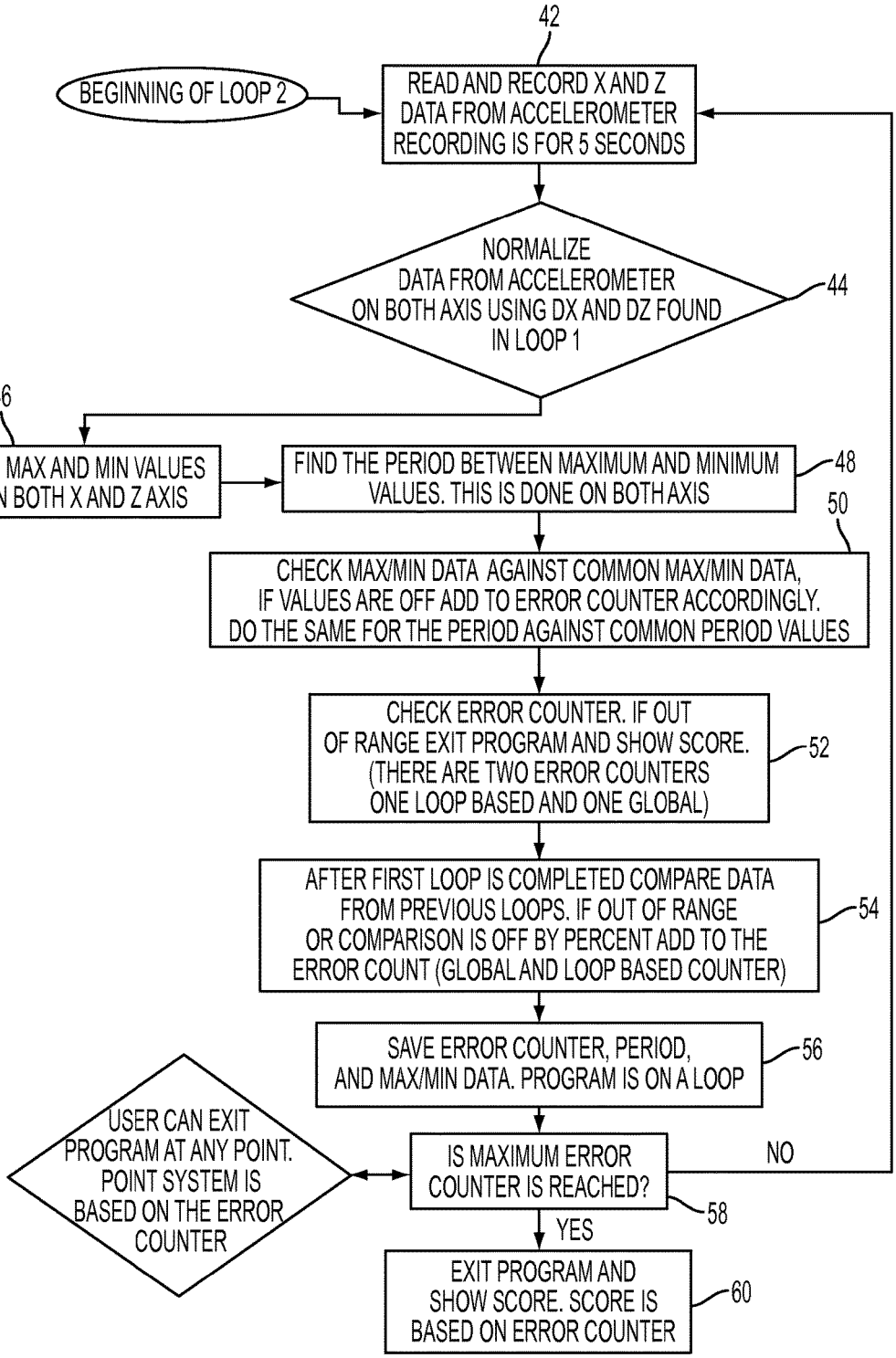
FIG. 4 is a continuation of the flow diagram of FIG. 3 showing the Loop 2 method steps.

Referring now to FIGS. 3 and 4, which are flow diagrams illustrating the method by which the device detects and processes movement data collected in real time. We established the calculation process for determining if any individual using the device 10 is simulating the motion required to keep a conventional hula hoop in continuous rotation about the hips. Initially, reference accelerometer data is collected from individuals known to be experts at the art of maintaining a conventional hula hoop in continuous rotation. This is referred to as an ideal range of data and is stored in the memory 22 and is used to establish an ideal range, speed and intensity of motion. The ideal range of data is a target for the user to aim for and to achieve success in when using the device 10. In the simulated hula example example, we initially plotted the motion data in 3-dimensions, namely the x-axis, the y-axis and the z-axis but we found that because of the minor variance in the data, the vertical y component of the motion could be ignored. Our extensive modeling proved that the motion in the remaining 2 horizontal axes x and z can each be represented by a sinusoidal curve with equations of the form:

$$X=A\sin(Bt+C)+D;\text{With Period}=2\text{pi}/B;\text{Phase}=C/B \quad (1)$$

$$Z=A\sin(Bt+C)+D;\text{With Period}=2\text{pi}/B;\text{Phase}=C/B \quad (2)$$

wherein D represents the offset from the neutral axis for the curves representing particular users; A represents amplitude; B represents angular frequency; and C represents phase. However, it is to be noted that for other applications, G forces can be measured along the x-, y- and x-axes.

These equations permit relative comparisons between data acquired from user with different movement patterns and intensities. The maximum and minimum permissible values of X and Z were determined by detailed analyses of the corresponding motions by the user that would cause failure. Such failure might include, for example, causing the rotating hoop to fall due to gravity. We translated these equations to a programming methodology that can be achieved using the device 10 having the computing power as illustrated specifically in the flow diagram of FIG. 3.

The flow diagram is a logic tree which begins at Loop 1 when the user initializes the global variables at step 28. If the user is using the device 10 for the first time, calibration at step 30 is needed before Loop 2, as illustrated in FIG. 4, can be initiated. If the user has not previously used the device 10, calibration of the device 10 is required for optimal performance. At step 32, the sensor 20 detects and reads G forces in the x- and z-axes as the user rotates his/her hips to mimic the movement of an imaginary hula hoop for 1 second. The x values represent forward and backwards movement of the user's hips; the y values represent side-to-side (lateral) movement of the user's hips. At step 34, maximum and minimum x and y values are obtained and stored as individual sets equal to individual i values, which are repeated if necessary. If at step 36 3 sets of maximum and minimum values are obtained', then at step 38 an average of these values is calculated using the following equation:

$$(\text{Max_}Xi+\text{Min_}Xi)/2 \tag{3}$$

If 3 sets of maximum and minimum values are not obtained, the step 32 is repeated. At step 40, from the averages between each minimum and maximum, the software then calculates an average of those averages to acquire DX and DZ (DX and DZ are normalizing criteria), using the following equation:

$$(\text{Average}X1+\text{Average}X2+\ldots+\text{Average}Xi)/i=DX) \tag{4}$$

After this, Loop 2, as illustrated in FIG. 4, is then initiated. At step 42, an additional set of data is collected for 5 seconds as the user rotates his/her hips to mimic the rotation of an imaginary hula hoop. The sensor 20 detects and reads a second set of G force data in the x- and z-axes. At step 44, the second set of data is normalized on both axes using DX and DZ found in Loop 1. At step 46, the maximum and minimum values of the G forces in the x- and z-axes is found and then at step 48, the period between the maximum and minimum values is found in both the x- and z-axes. At step 50, the maximum/minimum data is checked against common maximum/minimum data. If these values are off they are added to the error counter accordingly. This is repeated for the period against common period values. The phrase "common data" refers to data that is taken from all users from beginners to experts. The ideal reference data is collected from an expert in the sport, for example, an expert hula hooper, an expert golfer and the like. Data is collected from a wide range of users to verify that the method works.

At step 52, the program then checks the error counter. If the data is out of range, then the program is exited and the user is shown his/her score. There are two error counters; one loop based, the other is global. At step 54, after Loop 1 is completed, data is compared from previous loops. If these data are out of range, or the comparison is off by a predetermined percentage, this data is added to the error count (global and loop based counter). At step 56, the error counter, period and maximum/minimum error data is saved. At step 58, if maximum error counter is achieved, the program is exited and the score, which is based on the error counter, is shown to the user at step 60. At step 58, if no maximum error is reached, the program loops back to step 42 and additional data is collected in the x- and z-axes. At any time during the program, the user may exit. The point system is based on error count.

Figure 5:
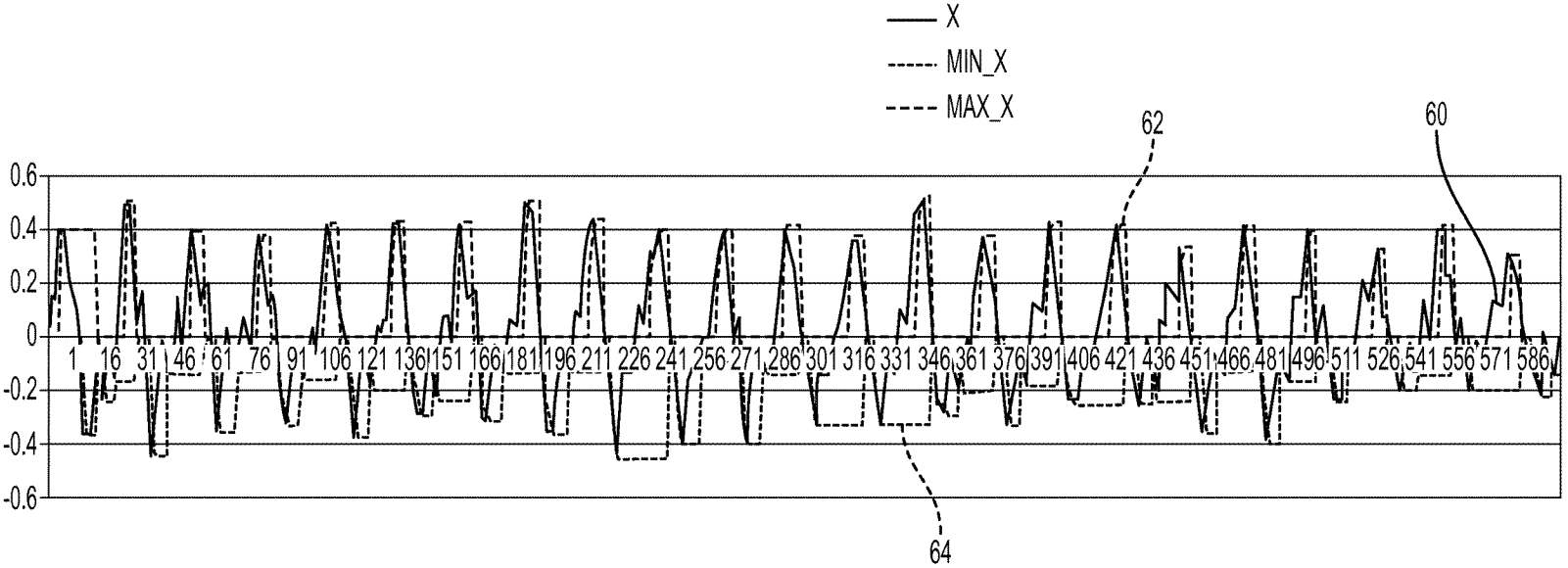
FIG. 5 is a graph showing plots of data collected for min_x, max_x and average x data.
Figure 6:
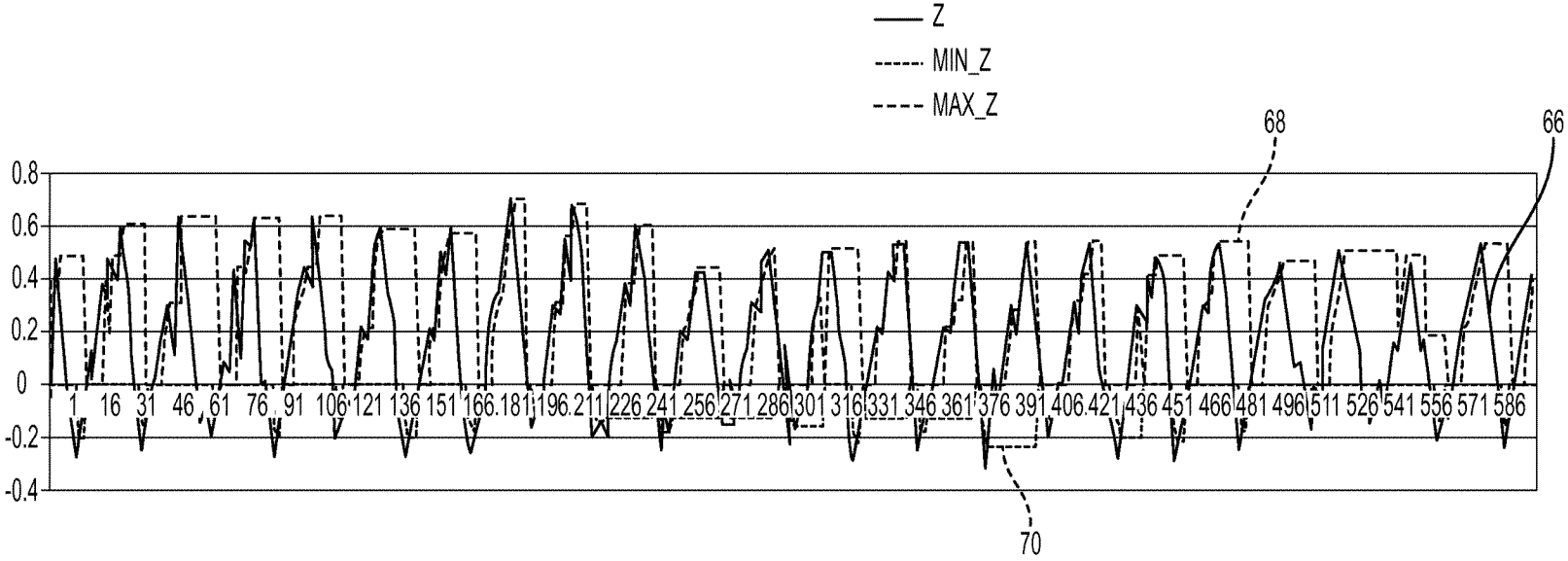
FIG. 6 is a graph showing plots of data collected for min_z, max_z and average z data.

Referring now to FIGS. 5 and 6, real time data is provided which illustrates the use of the software in finding the necessary maximum and minimum data for x- and z-values and periods and how they actually match up. The number (in Gs) are taken from an expert hula hooper as output by the accelerometer. On FIG. 5, line 60 in the graph is a plot of the period data, and lines 62 and 64 represent respectively the max, and min for data taken along the x-axis as found by the software. On FIG. 6, line 66 represents the period data, and lines 68 and 70 represent respectively the max, and min for data taken along the z-axis as found by the software. As illustrated, the data matches up very well.

Generally speaking, when the multi-position switch is switched to the ON position it activates the processor/computing unit 24. At this point all the components of the device 10 will be activated with the exception of the Bluetooth Transceiver and the Wi-Fi Transceiver, which can be activated by the user though a Graphical User Interface (GUI) displayed on the LCD Screen. The GUI is controlled by the processor/computing unit 24. If options are selected on the GUI, the memory 22 will be changed according to the new selections made by the user. The user can also access previously collected data, stored in the memory 22, though the GUI.

Once the user starts the program and moves his/her body, the sensor 20 obtains values based on the G-forces that the user creates in the x- and z-axes during movement. These values are computed by the processor/computing unit 24 and are stored in the memory 22. If a certain target is reached, the LCD Screen, LED Light, and/or amplifier will receive new data causing the speaker to emit sounds based on the type of data the amplifier receives.

The user selects an operating mode from one of the switches or buttons 18, after which the LCD Screen will display information, data, and options. The user will select what he/she wishes to do with the device 10 and the device 10 will then proceed to accomplish these commands. If the user wishes to play a game involving a virtual hula hoop, such as in an exercise routine, the device 10 will begin a countdown procedure and the user will then have to position themselves in the correct starting position, as one would normally do when using a real hula hoop. The game will then begin. Data will be collected by the sensor 22 and transmitted to the processor/computing device 24 where it is processed. The LCD Screen, LED Light, and the speaker will provide auditory and/or visual signals to the user based on the success or failure of the user to achieve the ideal; data range during the game. The user can then wirelessly upload his/her success to a personal; computer though the Bluetooth Transceiver or Wi-Fi Transceiver.

If the user intends to use the device 10 in a cell phone, smart phone, PDA, music playback device or any other electronic device containing the appropriate components, the software component can be installed in that device.

If the device is purchased as a complete system consisting of the electronic device described herein as well as the software component, no software installation is required. Prior to use, the device running the software must then be activated.

On first use of the device 10, a user name is entered. On subsequent uses, either a new (additional) user name can be entered or an existing one chosen.

When the user is using any device other than the electronic device described herein, the user must specify the orientation (horizontal versus vertical) and position or placement (front, side or back) on the body.

The desired performance standard or level is selected. At this point the user may select music, sounds, or visual effects and parameters to be used during use of the device 10. If data, sounds, or visual affects are to be transmitted to a computer, computer network, amplification or display device the appropriate transceiver must be activated.

The user would typically begin using the device 10 by pressing a start or ready or similar button, after which an auditory signal or visual count down would begin. This gives the user sufficient time to attach the device to the belt or other location on the put the electronic device in use at its appropriate spot on the body as input above.

At this point the person would begin the necessary body motion associated with maintaining a conventional hula hoop in continuous rotation. An instructional video explaining the desired motion is embedded within the software component.

The first 10 seconds of this motion is used to initialize or calibrate the device so as to account for different styles, degrees and intensity of motion that may vary from person to person. This calibration can be saved and associated with the person's user name so it does not have to be repeated each time the device 10 is used. The device 10 can be used in two different configurations. The software component only can be installed on an existing electronic device (cell phone, smart phone, PDA or portable music player containing the necessary electronic components). Alternatively, the software can be used with the dedicated hardware described herein.

Although the device 10 is illustrated and described with reference to an imaginary or virtual hula hoop, it is to be understood that almost any other system that is mechanical or bio-mechanical and requires motion in specific directions in space within precise tolerances compared to an ideal motion could benefit from this device 10. Other examples where such a device may be used could be a robotic device that is designed to perform specific movements or tasks or for sporting activities that require specific movements of a body part, which when measured could provide feedback to the user so that they may improve such movement, for example, hitting a baseball with a bat, swinging a golf club, or using a tennis racquet. Additional examples of contemplated use include typical exercises such as, for example push-ups, sit-ups, chin-ups and the like. Both positive and negative feedback can be provided to bring the users motion as close to the ideal as possible.

In the same manner as described above, the device may also be used during rehabilitation where physiotherapy is required and where precise joint or muscle movement is required in order to achieve the desired effect. Advantageously, the duration or number of repetitions of the therapeutic exercise can be stored, documented and transmitted to a database for analysis by a physician. This would permit the physician to closely follow the progress of the rehabilitation.

Although the above description relates to a specific embodiment as presently contemplated, it will be understood that the discovery in its broad aspect includes mechanical and functional equivalents of the elements described herein.

We claim:

1. A device for detecting repetitive movement of a waist of a user as if mimicking a hula-hoop exercise, the device comprising:

a sensor for measuring G forces along at least two axes when the user repeatedly rotates the waist as if mimicking the rotation of a hula hoop, the G forces having maximum/minimum values with a period determined therebetween;

a memory for storing first reference data, the first reference data being a range of reference data previously collected from hula hoop users;

a processor/computing unit, in communication with the sensor and the memory, for receiving data associated with the G forces measured along the at least two axes and for comparing the first reference data with the data associated with the G forces measured along the at least two axes; and at least one feedback component connected to the processor/computing unit for providing the user with a signal indicating that a degree of matching between the measured G forces and the first reference data has been achieved.

2. The device, according to claim 1, in which the G forces are measured along x- and z-axes.

3. The device, according to claim 2, in-which x- and z-values detected in the x- and z-axes are taken from a user who is rotating his hips as if moving a virtual hula hoop.

4. The device, according to claim 1, in which the G forces are measured along x-, y- and z-axes.

5. The device, according to claim 1, in which the movement of the body part in the x-axis is represented by $X=A \sin(Bt+C)+D$; With Period=2pi/B; Phase=C/B and the movement of the body part in the z-axis is represented by $Z=A \sin(Bt+C)+D$; With Period=2pi/B; Phase=C/B, wherein D represents an offset from a neutral axis for curves representing particular users; A represents amplitude; B represents angular frequency; and C represents phase.

6. The device, according to claim 1, in which the sensor is an accelerometer.

7. The device, according to claim 1, in which the sensor is a gyroscope for measuring changes in spatial position relative to a starting point.

8. The device, according to claim 1, in which the sensor, the memory, the processor/computing unit, and the feedback components are provided as a unitary body.

9. The device according to claim 1, is adapted to be worn on a user's belt or waist.

10. The device, according to claim 1, in which the at least one feedback component includes a speaker and an amplifier, LED lighting, an LCD screen, or a wireless transreceiver.

11. The device, according to claim 1, is a cell phone, a PDA, a smart phone or a music playback device.

12. A method for detecting repetitive movement of a user's waist as if mimicking a hula-hoop exercise, the method comprising:

electronically measuring G forces along at least two axes when the user repeatedly the rotates the waist in real time, as if mimicking the rotation of a hula hoop the G forces having maximum/minimum values with a period determined therebetween;

comparing first data associated with the G forces measured along the at least two axes in real time with first reference data, the first reference data being G forces measured along the at least two axes stored in a memory, the first reference data being taken independently from the first data, the first reference data being a range of reference data previously collected from hula hoop users; and providing feedback to the user in real time indicating that a degree of matching between the first data and the first reference data has been achieved.

13. The method, according to claim 12, in which the at least two axes are x- and z-axes.

14. The method, according to claim 13, in which values associated with x-axis represent forward and backwards movement of the user's hips and the values associated with the z-axis represent lateral movement of the user's hips.

15. The method, according to claim 13, includes: obtaining maximum and minimum x and y values and storing the values as individual sets equal to individual i values.

16. The method, according to claim 15, includes: obtaining 3 sets of maximum and minimum values; and calculating an average of these values is calculated using the following equation:

$$(\mathrm{Max}_Xi+\mathrm{Min}_Xi)/2.$$

17. The method, according to claim 16, includes: calculating an average of the averages to acquire DX wherein:

$$(\mathrm{Average}X1+\mathrm{Average}X2+\ldots+\mathrm{Average}Xi)/i=DX.$$

18. The method, according to claim 17, includes: electronically measuring an additional set of set of G force data in the x- and z-axes and normalizing the additional set of data on both axes using DX.

19. The method, according to claim 18, includes:

determining the maximum and minimum values of the G forces in the x- and z-axes;

determining a period between the maximum and minimum values is found in both the x- and z-axes;

comparing maximum/minimum data with common maximum/minimum data; and repeating for the period against common period values.

20. The method, according to claim 12, includes: providing audible or visual feedback to the user when the first reference data is achieved.

21. The method, according to claim 12, in which the user is moving the waist as if mimicking the movement of a hula hoop.

22. The method, according to claim 12, further includes: alerting the user when the user successfully achieves the first reference data.

23. The method, according to claim 12, further includes: alerting the user when the user fails to achieve the first reference data.

* * * * *